US005813922A

United States Patent [19]

Beach et al.

[11] Patent Number: 5,813,922

[45] Date of Patent: Sep. 29, 1998

[54] GOLF CLUB SHAFT

[75] Inventors: Todd Beach, San Diego, Calif.; Jean-Luc Veux, Rumilly, France

[73] Assignee: Taylor Made Golf Company, Inc., Carlsbad, Calif.

[21] Appl. No.: 951,032

[22] Filed: Oct. 15, 1997

[51] Int. Cl.[6] ..... A63B 53/10

[52] U.S. Cl. ..... 473/319; 273/DIG. 7; 273/DIG. 23

[58] Field of Search ..... 473/316–323, 473/319; 273/DIG. 7, DIG. 23

[56] References Cited

U.S. PATENT DOCUMENTS

| | | | |
|---|---|---|---|
| 2,050,554 | 8/1936 | Barnhart | 473/323 |
| 2,749,643 | 6/1956 | Scott | 43/18.5 |
| 2,934,345 | 4/1960 | Scott | 473/319 |
| 3,614,101 | 10/1971 | Hunter | 473/316 |
| 4,889,575 | 12/1989 | Roy | 273/DIG. 23 |
| 5,018,735 | 5/1991 | Meredith | 473/318 |
| 5,156,396 | 10/1992 | Akatsuka et al. | 473/319 |
| 5,326,099 | 7/1994 | Yamamoto et al. | 273/DIG. 23 |
| 5,385,767 | 1/1995 | Noguchi | 473/320 |
| 5,439,219 | 8/1995 | Vincent | 473/319 |
| 5,496,028 | 3/1996 | Chien | 473/323 |
| 5,551,691 | 9/1996 | Harada | 473/323 |
| 5,569,097 | 10/1996 | Veux et al. | 473/316 |
| 5,620,380 | 4/1997 | Tennent | 473/319 |
| 5,632,692 | 5/1997 | Lebovici | 473/317 |
| 5,665,010 | 9/1997 | Mori | 473/316 |
| 5,692,970 | 12/1997 | Nelson | 473/319 |
| 5,716,291 | 2/1998 | Morell | 473/319 |
| 5,735,753 | 4/1998 | Hoffmeyer . | |

FOREIGN PATENT DOCUMENTS 2250466 6/1992 United Kingdom .

*Primary Examiner*—Sebastiano Passaniti
*Assistant Examiner*—Stephen L. Blau
*Attorney, Agent, or Firm*—Greenblum & Bernstein, P.L.C

[57] ABSTRACT

A golf club shaft that is light in weight but which avoids problems related to a bending deformation of the section where these phenomena might otherwise occur. The bending strength of the shaft in the area sensitive to these phenomena is improved and the flexional and torsional stiffness characteristics are not significantly affected. Further, the mass and the mass distribution of the shaft are not significantly affected. According to one embodiment, the golf club shaft is tubular and includes a variable cross section along its length. The shaft has an enlarged butt at one end an a smaller radius tip at the opposite end. The shaft includes several layers of reinforcing fibers having different orientations with respect to the longitudinal axis, at least one of the layers being oriented at, or approximately at, 90° with respect to the longitudinal axis at least over a portion of the shaft where the external radius/thickness ratio is greater than or equal to 4. More particularly, the invention relates to shafts which comprise a radius/thickness ratio that is greater than the ratio of a conventional shaft in the bending area of the shaft length, i.e., the area which experiences a greater bending deformation during the swinging motion. A higher radius/thickness ratio in the bending area allows the shaft to be lightened while keeping proper mechanical properties of stiffness and strength by use of regular modulus carbon fibers which are less expensive than ultra-high modulus fibers.

20 Claims, 5 Drawing Sheets

GOLF CLUB SHAFT

CROSS-REFERENCE TO RELATED APPLICATION

This application is a continuation-in-part of application No. 08/744,049, filed on Nov. 6, 1996, abandoned, the disclosure of which is hereby incorporated by reference thereto in its entirety.

BACKGROUND OF THE INVENTION

1. Field of the Invention

The present invention relates to a golf club shaft and, more particularly, to a shaft made of a reinforcing fiber-base composite material.

2. Description of Background and Relevant Information

The current tendency is to manufacture increasingly lightweight golf clubs, due to the use of composite materials, in order to enable such clubs to be swung with less effort while obtaining the desired flexional and torsional stiffness characteristics of the shafts thereof. The swinging motion of a golf club shaft in striking the ball is a combination of a translational displacement and a rotational displacement. The reduction of the mass of the shaft therefore makes it easier to displace the club in translation during the swing. However, the mere lightening of the shaft causes an imbalance of the club by affecting its inertia. Therefore, corrections must be made to restore the desired balance by modifying the distribution of the mass of the shaft through a particular change in the shape of the shaft.

To achieve the desired mass distribution while adjusting the flexional and torsional stiffness characteristics of a lightened shaft, certain portions of the shaft must be enlarged with respect to the conventional composite shafts. The external diameter can reach an increase on the order of 20 to 50% with respect to that of a conventional shaft in certain zones, and is accompanied at the same time by a substantial reduction in the thickness of the walls. One of the advantages of having enlarged diameter regions is that it permits the use of lower cost standard modulus fibers to achieve the desired stiffness characteristics with a minimum thickness.

The problem is then related to the deformation of the structure in these enlarged zones. In certain portions, more particularly below the gripping zone where the bending stresses are very high, the enlarged section thus has a tendency to become oval during the bending, which results in creating substantial local stresses that render the shaft fragile.

U.S. Pat. No. 5,156,396 to Akatsuka et al. discloses a lightweight golf club shaft formed of a carbon fiber-reinforced plastic that includes a reinforcing layer with 90-degree oriented fibers with respect to the longitudinal axis. The reinforcing layer extends from the grip end through a length L3 of 100–800 mm, preferably 250–700 mm. The layer serves to improve the buckling strength of the shaft along a length extending from the grip end to a predetermined distance along the shaft. The reinforcing layer is also intended to form a grip-end reinforcing layer to prevent the crushing effect due to hand pressure around the thin-walled butt.

However, the shaft of U.S. Pat. No. 5,156,396 appears to be a structure produced by conventional molding methods using a shrinkable plastic tape. The specific design of the shaft is not particularly disclosed except for the dimensions of the butt and tip ends.

Another problem arises from the process used to manufacture a lightened shaft having an enlarged geometry. The traditional methods that consist of wrapping a ribbon of thermoshrinkable polyester film around the structure and then causing the film to compress the composite structure is not adapted to manufacture shafts with a complex enlarged shape. Therefore, the applicant had previously proposed to use a method as disclosed in United Kingdom Patent Application No. 2,250,466. The method comprises the steps of arranging a flexible, inflatable bladder around a rigid mandrel with layers of fiber sheets to obtain a substantially frusto-conical composite structure. The structure is then placed in a mold defining an internal impression that conforms to the shape of the shaft. A molded shaft is produced by first heating the mold, which produces a radiant heat on the composite structure. The heat causes the composite structure to soften. An internal pressure is then applied to the bladder so that the bladder inflates and causes the composite structure to expand through the gap. The bladder compresses the softened composite structure against the inner surface of the impression. The molded shaft is then cooled and removed from the mold. This process is particularly adapted for the production of enlarged shapes. However, the applicant has noticed that in the area of the larger expansion, the composite material must expand more during the internal bladder curing in these areas than in the remainder of the shaft length, as for example the tip end of smaller diameter. This expansion causes the fibers to be more wavy and wrinkled in these areas. The fiber waviness can result in reduced strength of the shaft in the region the phenomenon occurs.

Therefore, there exists a need to develop a solution that enables internal pressure molding a shaft with an enlarged shape without incurring the risk of wrinklage of the fibers in the expanded areas. This issue is absolutely not disclosed in U.S. Pat. No. 5,156,396, as the shaft appears to be produced by any conventional molding method.

SUMMARY OF THE INVENTION

An object of the present invention is to propose a solution that makes it possible to avoid problems related to ovalization of the section of a lightened shaft in enlarged bending areas of the shaft, which areas are subjected to a greater deformation than other regions.

As a result, there is an improvement in the bending strength of the shaft in the zone that is sensitive to these phenomena. According to another object of the invention, the bending strength is improved without the flexional and torsional stiffness characteristics being affected significantly.

According to another object of the invention and contrary to the disclosure of the prior art, in particular U.S. Pat. No. 5,156,396, the mass and distribution of the mass of the shaft are parameters that are also not significantly affected by the solution used by the invention.

To this end, the invention relates to a golf club shaft constituted by a tubular structure extending along a longitudinal axis and presenting, along its length, a varying section defined by an external radius and thickness of the structure;

the shaft including a butt having an external radius and an opposite tip with a smaller external radius than the external radius of the butt;

the shaft including a gripping zone in the vicinity of the butt and a large diameter bending zone of greater deformation during a swinging motion located beneath the gripping zone:

the large diameter bending zone having a radius/thickness ratio greater than 4 and including a portion of abrupt increase of the r/e ratio in the direction toward the tip;

the structure including several layers of reinforcing fibers having different orientations with respect to the longitudinal axis;

the structure including at least one layer of fibers oriented at, or approximately at, 90° with respect to the longitudinal axis that extends at least over the large diameter bending zone and that is spaced from the butt.

Therefore, the solution of the invention teaches that the arrangement of a 90-degree reinforcement layer of fibers provides a significant advantage in the enlarged bending area where the radius/thickness ratio is substantial, which corresponds to the areas where the problems of ovalization and resistance cited hereinabove are encountered. The 90-degree reinforcement layer is also preferably avoided in the region where the ovalization phenomenon is not so critical, i.e., in the gripping region or in the tip diameter area, so that the total weight of the shaft can be kept as low as possible and it is possible to achieve an optimum lightening/resistance compromise for the shaft.

In contrast to shafts having conventional designs and/or dimensions, the present invention relates more particularly to golf club shafts which have an enlarged geometry below the gripping area. More particularly, the invention relates to shafts which comprise a radius/thickness ratio that is greater than the ratio of a conventional shaft in the bending area of the shaft length, i.e., the area which experiences a greater bending deformation during the swinging motion. A higher radius/thickness ratio in the bending area allows the shaft to be lightened while keeping proper mechanical properties of stiffness and strength by use of regular modulus carbon fibers which are less expensive than ultra-high modulus fibers. The problem is that due to its expanded geometry, the bending area experiences a radial deformation which causes the circumference of the shaft to become more fragile. This phenomenon does not occur when the shaft has a regular size.

Preferably, the layer of fibers oriented at, or approximately at, 90 degrees, is remote from the butt over a distance between 200 to 400 mm. This range corresponds to the beginning of the effective bending area where the bending deformation is maximum during the swinging motion. The use of a discrete layer spaced from the butt help to lighten the club shaft as much as possible.

In another aspect of the invention, the large diameter bending zone can be separately defined as having at least a significant enlarged portion where the radius/thickness ratio is greater than or equal to 6. More particularly, the enlarged zone has a length of at least 50 mm. preferably 100 mm. Such an enlarged zone is unusual for a conventional shaft. Preferably, the enlarged portion extends in the direction of the tip to a distance from the butt of at least 350 mm, more preferably 380 mm.

According to the invention, this structure includes at least one layer of fibers oriented at, or approximately at, 90 degrees with respect to the longitudinal axis that is spaced from the butt and extends at least over the enlarged portion. Therefore, the enlarged portion of the bending zone is properly reinforced while the weight of the shaft can be maintained as low as possible.

Another aspect of the invention relates to the problem of wrinklage of the fibers which occurs during the molding process of shafts with enlarged areas as the one of the invention. Surprisingly, the applicant has obtained a complete disappearance of the phenomenon of wrinklage when the previously designated layer of reinforcement is a fiber cloth that includes both fibers oriented at, or approximately at, 90 degrees with respect to the longitudinal axis and fibers oriented at, or approximately at, 0 degrees with respect to the longitudinal axis.

The cloth appears to give enough circumferential and axial stiffness to hold the shape during bladder expansion and minimize fiber waviness in the other adjacent unidirectional 0 and ±45 degree plies constituting the remainder of the structure. This results in a significant increase of the bending strength of the shaft in the enlarged area. As previously explained, the bending region located just below the gripping area corresponds to a critical zone that needs to be reinforced in that way. On the other hand, the dimensions of the cloth, as well as its location, must be precisely determined so as to keep the weight of the shaft as low as possible. Indeed, the cloth has a density which is generally much higher than a unidirectional fiber layer and, therefore, can influence more easily the total weight of the shaft.

BRIEF DESCRIPTION OF THE DRAWINGS

Other characteristics and advantages of the invention will be better understood by means of the description that follows, with reference to the annexed drawings illustrating the invention by way of non-limiting examples, and in which.

DETAILED DESCRIPTION OF THE PREFERRED EMBODIMENTS

Figure 1:
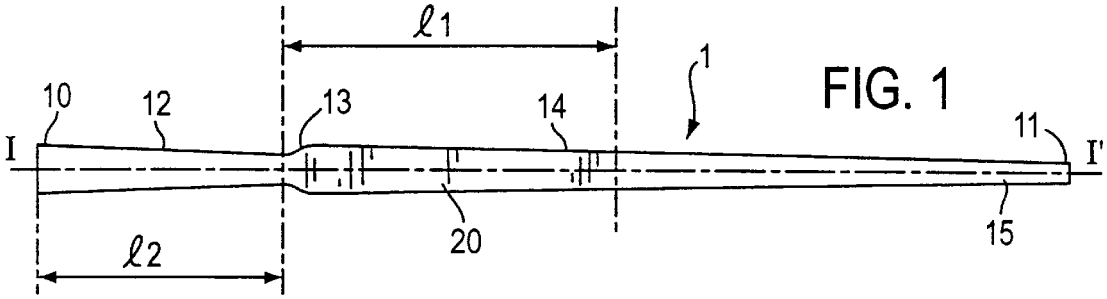
FIG. 1 shows an example of the composite shaft according to the invention.
Figure 2:
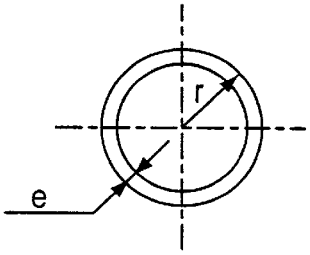
FIG. 2 is a cross-sectional view of the shaft of FIG. 1.

FIGS. 1 and 2 show a shaft 1 extending along an axis I—I' having a particular shape that allows for an advantageous distribution of the mass and of stiffness.

The shaft includes a hollow tubular structure having a radius r and a thickness e. It includes an enlarged butt 10 and an opposite tip 11 with a smaller external radius r.

From the butt 10 extends a first upper portion 12 corresponding substantially for a part of it to the gripping zone. Normally, the first upper portion will be slightly longer than the intended gripping zone. The first upper portion 12 is connected to a second flared portion 13 in which the external radius r increases locally toward the tip, then a third reversely flared portion 14 connected to the second flared portion 13 in which the external radius r diminishes progressively toward the tip. Finally, the shaft is ended by a fourth cylindrical portion 15 that is connected to the third portion 14 and extends up to the tip 11. The lower part of the upper portion 12 along with the second flared portion 13 and the upper part of the third reversely flared portion 14 can include a larger diameter or enlarged bending zone which is susceptible to aforementioned ovalization phenomena. The edge of the junction between two adjacent portions can be rounded off to achieve a smoother contour of the shaft profile.

The first upper portion 12 has a flared and enlarged portion in which the external radius r decreases progressively up to the connection of the first portion 12 to the second portion 13 in order to attach a thin and lightweight grip (not shown) of less than or equal to 35 grams. One of the benefits for using such a lightweight grip is to lower the weight of the club and to improve the overall balance of the entire club. The second short flared portion is intended to produce an enlargement of the section of the shaft so as to increase the mechanical characteristic of the shaft without affecting the weight of the shaft.

Figure 3:
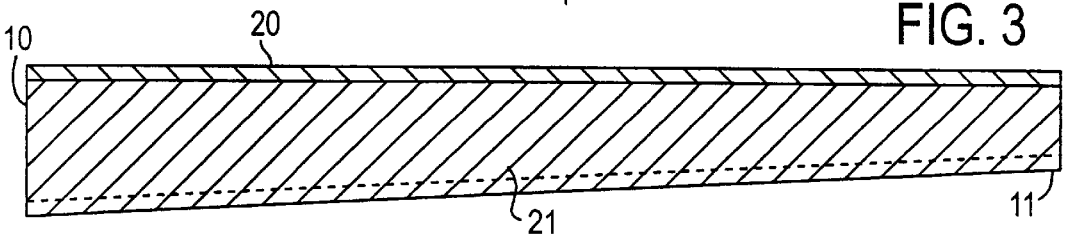
FIGS. 3–5 schematically show the construction of the shaft, in particular the assembly of the various layers to one another.
Figure 4:
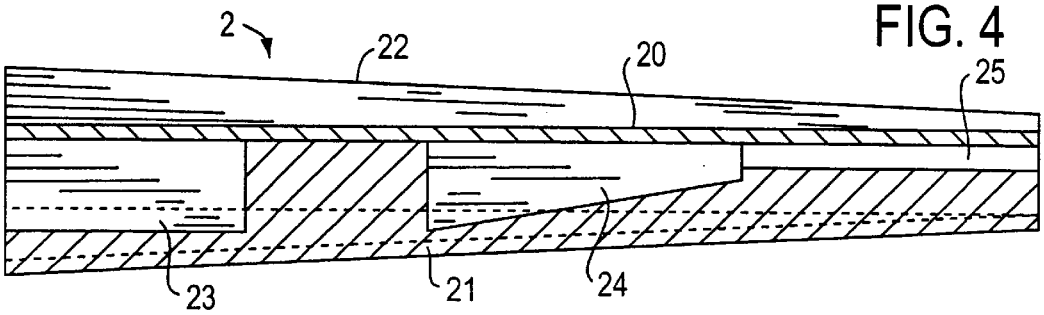
Figure 5:
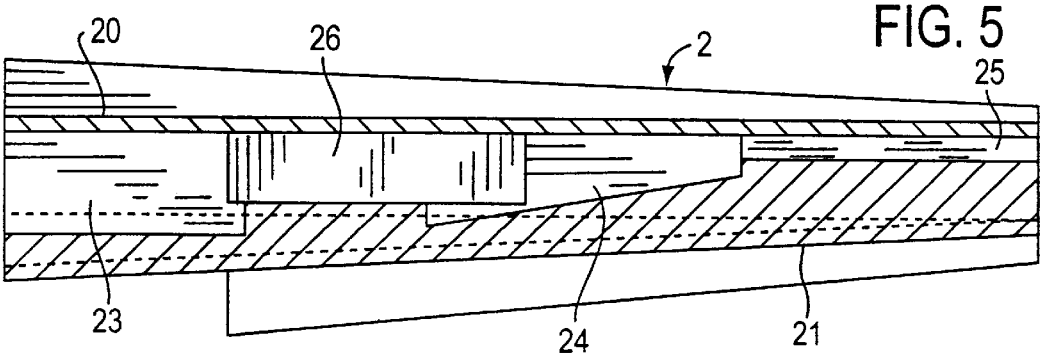

FIGS. 3–5 show, by way of example, the arrangement of the layers to form a composite complex 2 that is ready to be wound about a molding mandrel.

One first joins two layers 20, 21 of oppositely oriented fibers whose value is substantially equal to ±45 degrees, respectively (i.e., one layer being oriented substantially at +45 degrees and the other layer being oriented substantially at 45 degrees), with respect to the longitudinal axis I—I'. In view of the orientation of the fibers, the layers 20, 21 essentially ensure the stiffness characteristics during the torsional deformation of the shaft. Therefore, they must extend along the entire length of the shaft. They each have a trapezoid configuration and are joined in a slightly offset and overlapped manner.

In view of the general shape of the shaft, it is to be understood that the values of the angles of + (plus) and – (minus) degrees cannot be reproduced perfectly over the entire length of the shaft, and variations of a few degrees can occur between the butt 10 and the tip 11.

To ensure an appropriate distribution of flexural strength, layers of fibers 22, 23, 24, 25 oriented at zero degrees with respect to the axis I—I' are arranged on the complex to be wound. The trapezoid layer 22 is preferably a layer whose length is equal to that of the shaft. Other layers 23, 24 and 25 have particular lengths arranged in appropriate areas on the shaft to obtain the desired stiffness distribution.

According to an important characteristic of the invention, a layer 26 of fibers oriented at, or approximately at, 90 degrees with respect to the longitudinal axis of the shaft, is attached on the complex. The layer can be either a unidirectional 90-degree fiber sheet or a bi-directional 0/90-degree fiber sheet. The bi-directional 0/90-degree fiber sheet is preferably a cloth or fabric, such as that formed by woven or non-woven threads oriented at 0° and 90°. As will be explained shortly hereinafter, the preference is given to a 0/90-degree fiber cloth as it reduces the waviness of the fibers in the bending region of the shaft during the molding operation.

A dispersion of the angle of orientation of ±15 degrees maximum is considered as being substantially close to either 90 degrees or 0 degrees and remains within the scope of the present invention. However, a dispersion of less than ±5 degrees is preferred to obtained the optimum results for the invention.

The layer 26, that will be referred to as a "90-degree fiber layer" subsequently, for more clarity, is arranged in the area of the shaft where the previously mentioned problems of ovalization are encountered.

More particularly, the layer 26 is positioned at a distance from the butt end comprised between 200 and 400 mm, preferably 230 to 300 mm, and extends a length of between 40 to 500 mm, preferably 100 to 300 mm, so as to cover the bending area of the shaft without affecting significantly (i.e., without significantly adding to) the total weight of the shaft.

Figure 11:
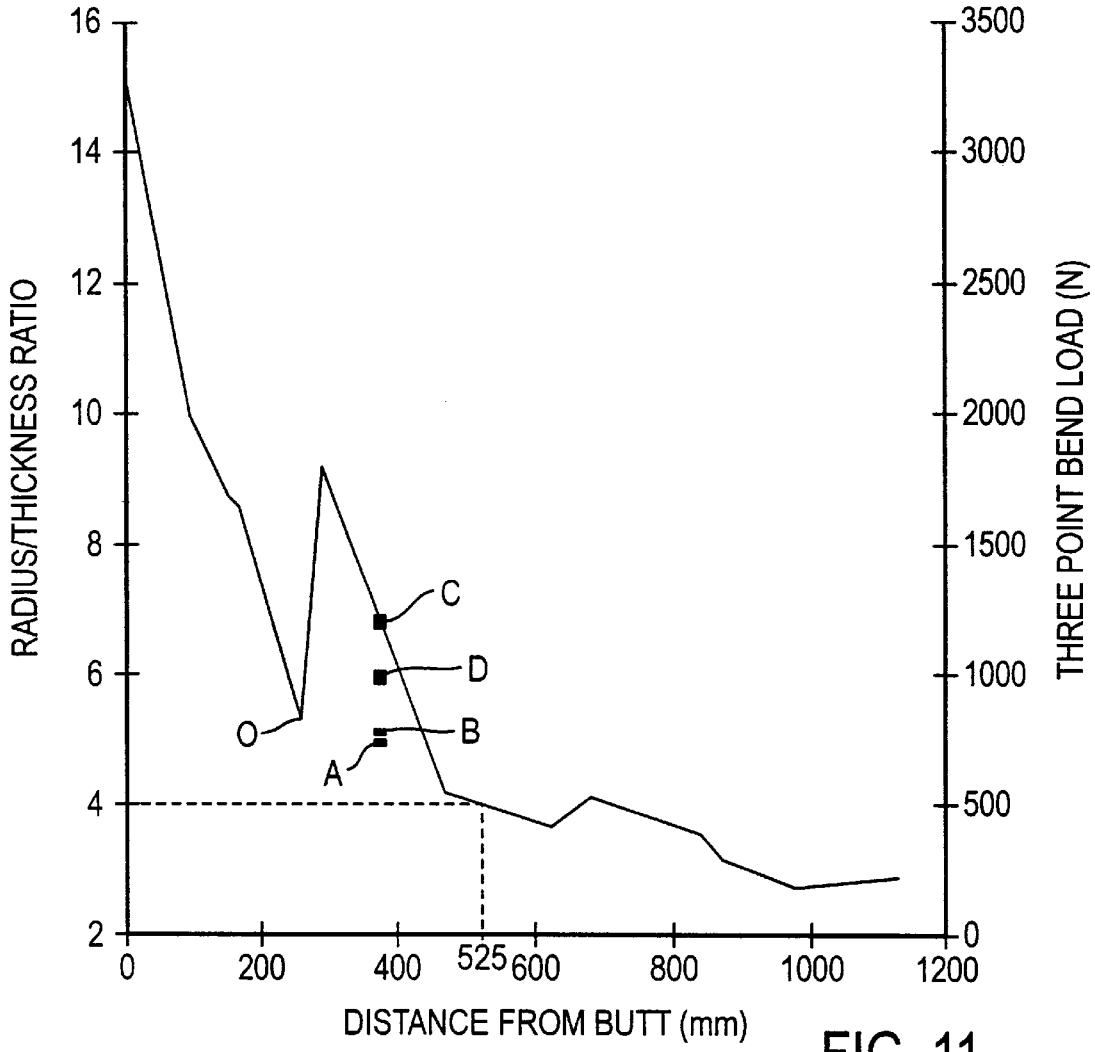
FIG. 11 is a graph showing the variation of the radius/thickness ratio along the shaft and partially reporting the result of the bending test (in Newtons) of FIGS. 6–7.

FIG. 11 has a curve which shows the variation of the ratio of the external radius r to the thickness e (on the left ordinate) of the structure along the shaft (on the abscissa) for the aforementioned preferred example of the invention. The problems of structure deformation, that are capable of leading to a fracture of the fibers, are mainly noticed in the zone of the peak or abrupt variation of the r/e ratio corresponding to a larger radius bending zone of the shaft. The abrupt variation comprises a portion of increase of the r/e ratio in the direction toward the tip that is greater than 30%, preferably greater than 40%, from a point 0 corresponding to a minimum ratio value plotted on the graph. This abrupt increase participates to the enlargement of the bending region so that the bending region comprises a significant enlarged portion where the radius/thickness ratio is equal to or greater than 6 and can reach a maximum value of 8 and above. Such enlarged portion may have a length of at least 50 mm, preferably comprised between 80 and 150 mm, and may extend in a direction of the tip until a distance from the butt of at least 350 mm, preferably 380 mm. In such an enlarged portion below the gripping area, the shaft is very sensitive to the phenomena of ovalization and fracture of the fibers.

More specifically, the 90-degree fiber layer should preferably locally cover the large radius bending zone located approximately along the second upper quarter of the shaft length in which the r/e ratio is greater than or equal to 4. Indeed, it is noted that this bending zone located below the gripping zone, is subject to very substantial flexional forces and may undergo substantial deformation amplitudes.

In order to determine the influence of the 90-degree fiber layer in the structure of the shaft, comparative 3-point bend load tests have been conducted on various shafts (A), (B), (C), (D).

The shaft (A) corresponds to the reference. This is a shaft of the type of FIG. 1, with a mass equal to about 60 g without a 90-degree fiber layer. These basic characteristics are as follows:

layers 20 and 21: HTA carbon fibers at ±45 degrees (HTA is the designation of a standard modulus and strength fiber from TOHO); Fiber Aerial Weight (FAW) of 70 gms/m$^2$, epoxy resin content of 40% by weight;

layers 22, 23, 24, 25: HTA carbon layer at 0 degrees; Fiber Aerial Weight (FAW) of 115 gms/m$^2$, epoxy resin content of 40% by weight.

The shaft (B) has the same basic structure as (A), with an additional HTA-type layer (1 revolution) of carbon oriented at 0 degrees, FAW of 70 gms/m$^2$. The layer has a length of 550 mm, with a width of 64 mm on the side of the butt and a width of 34 mm on the side of the tip. The layer is located at 230 mm from the butt 10. The layer adds about 4 grams of mass.

The shaft (C) has the same basic structure as (A), with an additional HTA-type layer (1 revolution) of unidirectional carbon fibers oriented at 90 degrees with respect to the longitudinal axis, and a FAW of 70 gms/m$^2$. The layer has the same dimensions and is located in the same area as the additional layer (B).

The shaft (D) has the same basic structure as (C) with a replacement of the additional HTA-type layer by a 90-degree M40J-type layer, and a FAW of 70 gms/m$^2$. The M40J-type has a higher elastic modulus than the HTA-type.

The main characteristics of the four shafts tested are carried to the following table:

| Ref. | Mass (in g) | Position CG/butt (in millimeters) | Inertia (Kg·mm$^2$) |
|---|---|---|---|
| (A) | 61.4 | 519 | 6320 |
| (B) | 66 | 519 | 6520 |
| (C) | 65.5 | 518 | 6520 |
| (D) | 65.3 | 518 | 6560 |

In order to determine the general flexibility of each shaft during bending, a flexibility measurement test is conducted. The method consists of fixing one of the ends of the shaft, then of measuring the deflection caused by a load of 2.7 Kg hanging from the other end of the shaft. The test is conducted by fixing the butt portion ("flex butt"), then the same test is conducted by fixing the tip portion, respectively at various distances from the butt ("flex tip").

Figure 6:
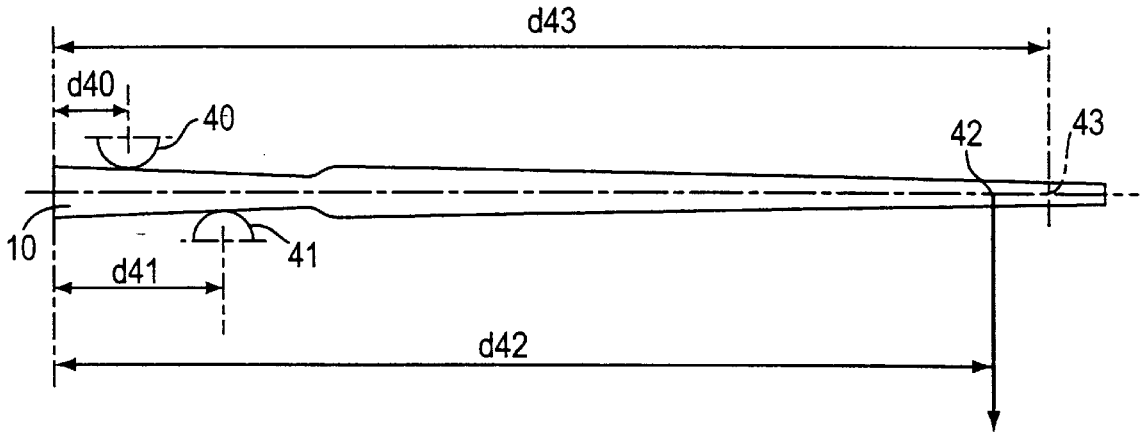
FIGS. 6–7 show the test conditions for measuring the general flexibility of the shaft.

FIG. 6 shows the test of flexibility which consists of fixing the butt 10 ("flex butt") between two points; respectively, an upper point 40, and a lower point 41; each of them located in the vicinity of the butt 10 at a respective distance d40 and d41.

The load is applied at the opposite end at a point 42 spaced from the butt 10 over a distance of d42. The deflection of the shaft is measured at a point 43 located at distance d43 from the butt end 10.

Figure 7:
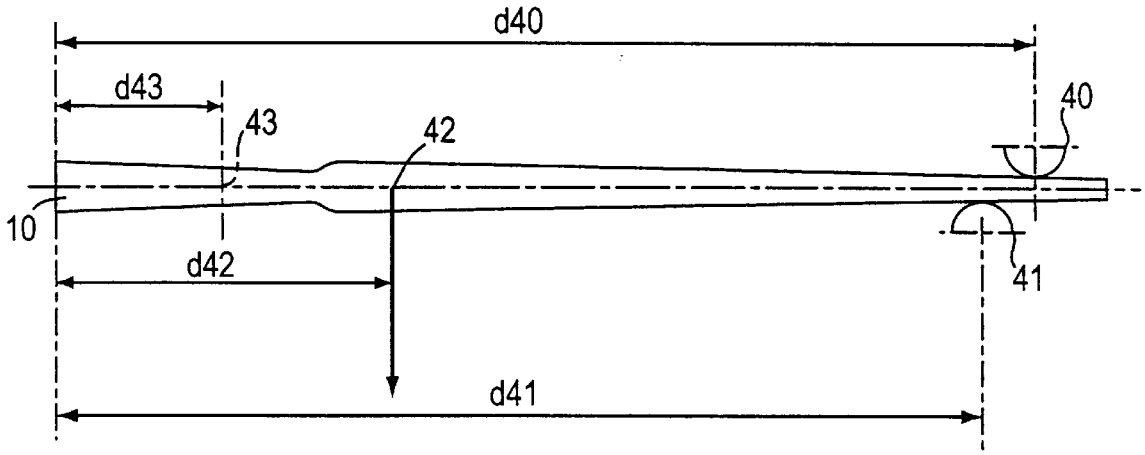

FIG. 7 shows the test of flexibility which consists of fixing the tip 11 ("flex tip") for which four different tests are performed at various distances of points 40, 41, 42, and 43. The general conditions of measurement are the following:

| | |
|---|---|
| • Flex butt: | |
| d40 = 12.7 mm | d41 = 127 mm |
| d42 = 882.6 mm | d43 = 971.6 mm |
| • Flex tip: | |
| 1st Test (1): | |
| d40 = 1070 mm | d41 = 1020 mm |
| d42 = 403 mm | d43 = 315 mm |
| 2nd test (2): | |
| d40 = 968 mm | d41 = 918 mm |
| d42 = 301 mm | d43 = 213 mm |
| 3rd test (3): | |
| d40 = 866 mm | d41 = 816 mm |
| d42 = 200 mm | d43 = 112 mm |
| 4th test (4): | |
| d40 = 764 mm | d41 = 714 mm |
| d42 = 98 mm | d43 = 10 mm |

The results are transferred to the following table:

| | Flex Butt | Flex Tip (in mm) | | | |
|---|---|---|---|---|---|
| Ref.: | (in mm) | (1) | (2) | (3) | (4) |
| (A) | 97.6 | 123.0 | 104.7 | 88.3 | 75.4 |
| (B) | 91.3 | 123.8 | 103.3 | 84.6 | 66.6 |
| (C) | 97.5 | 125.6 | 108.5 | 90.8 | 73.8 |
| (D) | 95.8 | 121.5 | 105.3 | 89.0 | 72.9 |

Very little variation of stiffness flexibility is noted between the shafts of the invention (C) and (D) and the reference shaft (A). On the contrary, for shaft (B), the values in deflection of flex butt and tip flex in the 4th test are much lower than for the reference shaft (A). For the shaft (B), this indicates problems in maintaining the desired flexibility characteristics with respect to the reference shaft (A).

Figure 8:
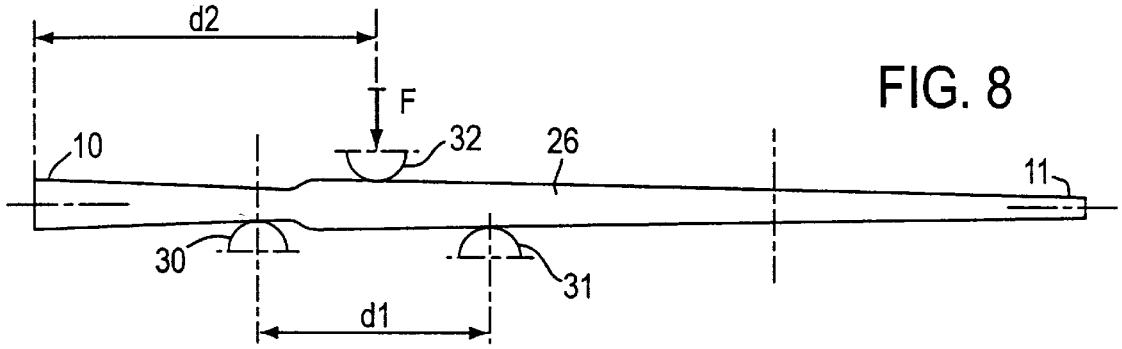
FIGS. 8–10 show the progression of a 3-point bend load measurement test at three different locations on the shaft.
Figure 9:
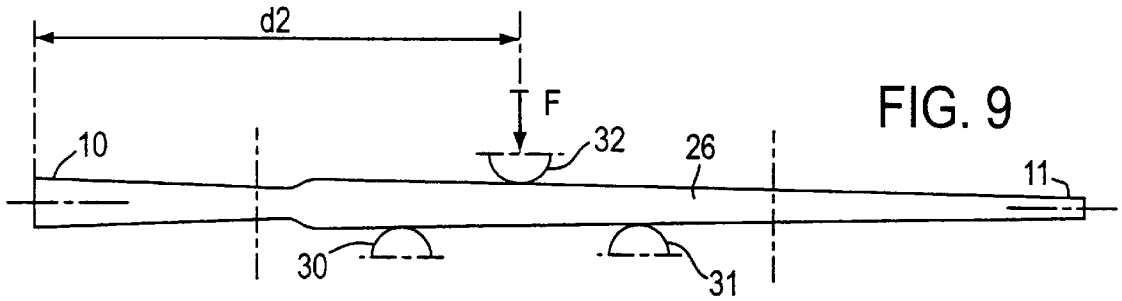
Figure 10:
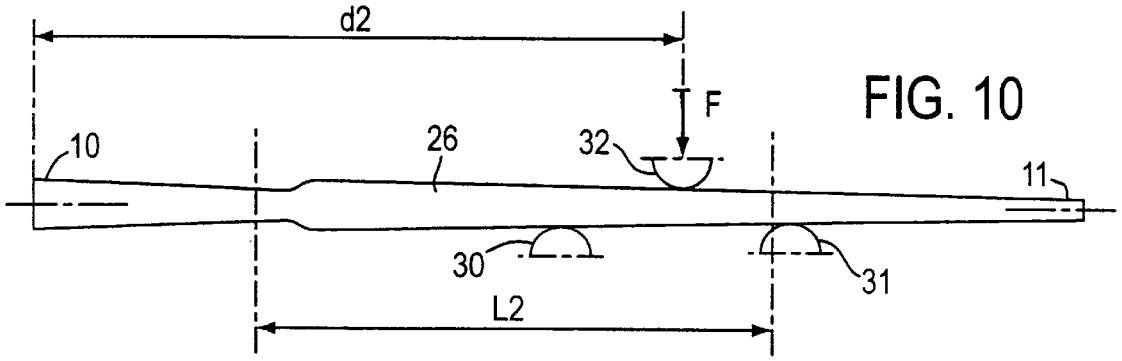

In order to determine the local resistance of the shaft, a 3-point bend load test is conducted which consists of applying a bending load centered between two supports spaced apart over a certain distance. FIGS. 8–10 show the measuring method. The supports 30, 31 are spaced from one another over a distance (d1) of 300 mm. A first measurement is performed by applying a load 32 at a distance d2 of 370 mm from the butt 10, as shown in FIG. 8. The load is applied at d2=525 mm for FIG. 9. The load is applied at d2=700 mm for FIG. 10. The additional fiber layer of references (B), (C), (D) has a length L2 of 550 mm, such that the load 32 is applied at an area where the additional layer is still present (FIG. 10).

The resistance measurements are performed for comparison between the four shafts, and the results are carried to the following table:

| | 370 mm | 525 mm | 700 mm |
|---|---|---|---|
| Radius (r) | 8.2 mm | 6.4 mm | 5.8 mm |
| Radius/thickness | 6.8 | 4.0 | 4.0 |
| Ref.: | | | |
| (A) | 750N | 653N | 588N |
| (B) | 767N | 742N | 708N |
| Gain | +2% | +14% | +20% |
| (C) | 1184N | 815N | 657N |
| Gain | +58% | +25% | +12% |
| (D) | 1000N | 802N | 630N |
| Gain | +33% | +22% | +7% |

Only the results of the resistance measured at 370 mm are plotted as points on the graph in FIG. 11, which corresponds to the scale on the right ordinate representing the 3-point bend load in Newtons.

In view of the above table and of the graph of FIG. 11, one notes that the most significant influence on the resistance values occurs when an additional 90-degree fiber layer is localized in the area of 370 mm from the butt, in other words, in the area where the ratio r/e is greater than 4, preferably greater than 6, and simultaneously where the radius has reached a certain minimum value, i.e., the radius is also greater than or equal to 6 mm, preferably greater than 7 mm.

The influence on the bending strength of the additional fiber layer oriented at zero degrees is negligible in the zone of 370 mm (+2% improvement with respect to the reference (A)).

At a distance of 525 mm from the butt, the 90-degree layer provides a significant improvement of the results. This position corresponds to an r/e ratio equal to about 4 and also a radius r equal to 6.4 mm.

At 700 mm from the butt, where the radius is less than 6 mm, the noted improvement is negligible for the references (C) and (D). On the contrary, one notes that the resistance of the shaft is improved for the reference (B) with the zero-degree layer which corresponds to the conventional method for increasing the bending strength of the shaft and also increases the local bending stiffness as noted in the previous flexibility tests. This indicates that the use of an additional zero-degree layer may significantly improves the bending strength when r/e is greater than 4 and the radius is also less than or equal to 7, preferably less than about 6 mm.

Therefore, one can consider that the fiber layer oriented at 90 degrees must be advantageously placed on a portion at least of the zone of the shaft in which the r/e ratio is greater than or equal to 4 and also in which the radius is greater than or equal to 6 mm. Of course, such a zone can be varied as a function of the geometry and of the dimensions of the various portions of the shaft, since the shaft of FIG. 1 only constitutes a non-limiting example from which it would be limiting, for the scope of the invention, to retrieve precise numerical data.

Figure 12:
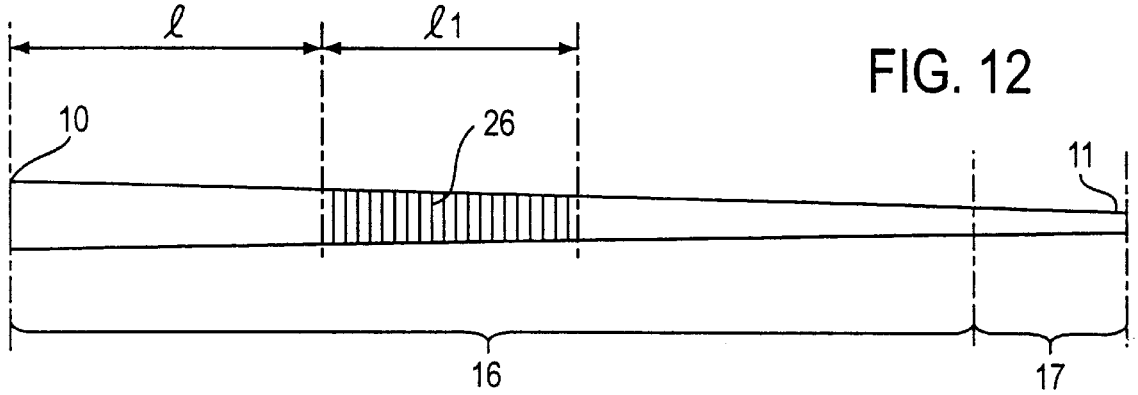
FIG. 12 shows a different embodiment of a shaft according to the invention.

The invention can be applied for shafts having a more conventional design but still being enlarged in the bending region, such as shown in FIG. 12. The shaft has a general shape with a main portion 16 that has a progressive or continuous reduction of the external radius of the butt 10 toward the tip 11. The shaft has a general diameter distribution which is greater than a conventional shaft so that the radius/thickness ratio is higher than 4 along at least a significant part of the bending zone and below the gripping area corresponding substantially to length l . In that case, the 90-degree layer will have to be located at least at a distance l of 200 mm, preferably 230 mm, from the butt end 10 and extend along a length $l_1$, of between 40 and 500 mm, preferably between 100 and 300 mm, depending upon the length of the enlarged bending area. The shaft can be advantageously ended by a cylindrical portion 17 adapted to be more or less cut as a function of the length of the shaft to be attached on each club.

For certain lightened shafts having this geometry, the bending area has also a particularly high r/e ratio. Therefore, problems of ovalization and breakage are found in this fragile area, that are similar to the problems of flexional deformation of the shafts of the type of FIG. 1. The presence of a layer 26 in the tubular composite structure, just below the grip area, therefore provides a satisfactory solution to the encountered problems of the bending failure in large diameter bending zone just below the grip zone. Advantageously, the layer 26 originates at a certain distance from the butt 10 and extends in the direction of the tip over a certain useful length.

Figure 13:
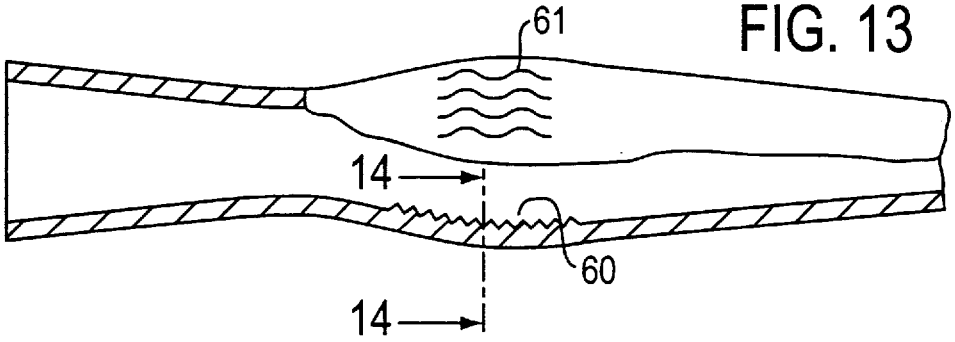
FIG. 13 shows a partial cross-sectional view of a defective shaft which does not apply the solution of the invention.
Figure 14:
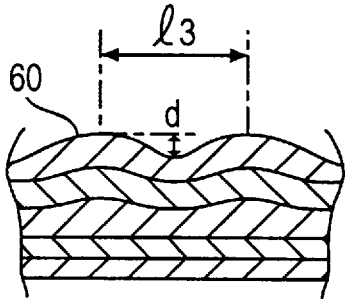
FIG. 14 shows an enlarged view of a detail of FIG. 13.

FIGS. 13 and 14 highlight another problem which occurs for the shaft with an enlarged bending area as the one of the invention. The shaft of the invention is produced by a process using an internal pressure which is applied inside a bladder. The bladder inflates and causes the composite structure to be molded against the impression of a female mold. This expansion causes the fiber to wrinkle in the enlarged portion of the bending zone 20. This results in the formation of inner radial waves 60 at the surface of the innermost ply. The defect is surprisingly concentrated only in a localized region corresponding to an r/e ratio of at least equal to 6. The applicant has noticed that the average length $l_3$ between two waves can be about 10 mm and the depth d of a wave can be about 1 mm. Another type of waviness can occur in the longitudinal direction of the shaft. The fibers experience a longitudinal deformation in a shape of longitudinal sinusoidal waves 61 that lessen the strength of the shaft.

Figure 15:
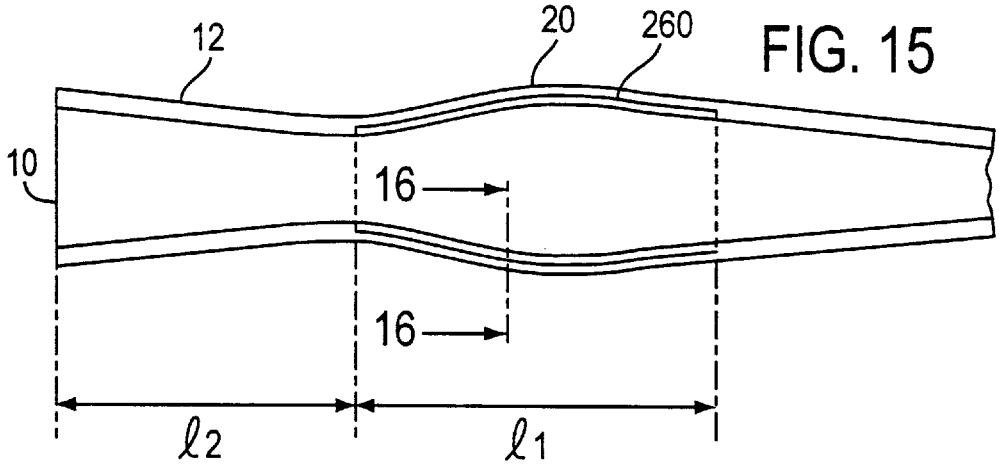
FIG. 15 shows a view similar to FIG. 13, butt of the shaft of the invention.
Figure 16:
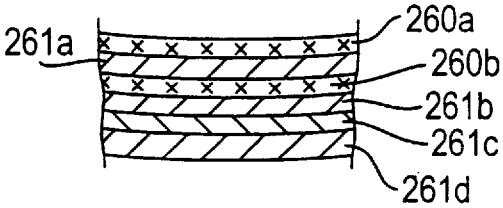
FIG. 16 shows an enlarged view of a detail of FIG. 15.

FIG. 15 illustrates a shaft of the invention including a ply 260 of 0/90-degree fiber cloth. According to the invention, the ply of cloth is spaced from the butt and extends at least over the enlarged portion. The cloth can successfully reduce the waviness of the fibers in the enlarged portion of the bending area of the shaft. The cloth is basically stiffer than unidirectionally oriented fibers and cannot distort easily. Therefore, it helps the fibers of the unidirectional plies expand more uniformly without wrinkling or rotating. The radial location of the 0/90-degree fiber cloth within the composite structure can be chosen to obtain the best results. After helicoidal winding, the cloth can have one or two turns around in the rolled composite structure depending upon the width of the ply and the diameter of the section. FIG. 16 shows a cross-sectional view in the enlarged region of the shaft. The cloth comprises two turns 260*a*, 260*b*. The turn 260*a* is the innermost run of the composite structure. As the composite structure is wound from a flat lay-up of various plies arranged in a slightly overlapping configuration, a turn of unidirectional fibers 261*a* can separate the turns of the cloth. Thus, due to the position of the turns, the cloth, which is a more rigid layer, experiences lower stretching forces during the operation of molding. The composite structure comprises other additional unidirectional turns 261*b*, 261*c*, 261*d*. On average, the composite structure comprises five to seven turns in total, including the turns of cloth.

In a general fashion, and in view of the diversity of the geometry and of the dimensions of the shafts, one can determine that the ply or layer has a length $l_1$ comprised between 40 and 500 mm and is remote from the butt over a distance $l_2$ comprised between 200 and 400 mm.

As for example, the width of 0/90-degree fiber ply can be 65 mm, the length can be 165 mm and it can be positioned in the enlarged portion at a distance of 220 mm from the butt. The cloth is a plain weave with 205 grams per square meter FAW.

The invention is primarily directed to lightened shafts, i.e., those whose mass is less than 85 grams, preferably those that are less than 75 grams. In this case, the 90-degree layer, or 0/90 degree layer, must not exceed 15 grams in order to affect in the least possible the balancing characteristics of the shaft and, therefore, of the entire club.

The layers constituting the structure of the shaft according to the invention essentially have a carbon fiber basis, but they can be replaced, totally or partially, by other fibers such as glass fibers, for example.

The invention is not limited to the embodiments described and represented by way of examples, but it also includes all of the technical equivalents as well as their combinations within the scope of the claims that follow.

What is claimed is:

1. A golf club shaft comprising:

a tubular structure extending along a longitudinal axis and having, along its length, a varying section defined by an external radius and a thickness of said structure;

said shaft including a butt having an external radius and an opposite tip with a smaller external radius than the external radius of said butt;

said shaft including a gripping zone in a vicinity of said butt and a large diameter bending zone of greater deformation during a swing motion located beneath said gripping zone;

said large diameter bending zone having a radius/thickness ratio greater than 4 and including a portion of abrupt increase of the radius/thickness ratio in direction toward a tip;

said structure including a plurality of layers of reinforcing fibers having different orientations with respect to said longitudinal axis; and said structure including at least one layer of fibers oriented at 90 degrees, or approximately at 90 degrees, with respect to the longitudinal axis that extends at least over said large diameter bending zone and that is spaced from the butt.

2. A golf club shaft according to claim 1, wherein said fiber layer oriented at 90 degrees, or approximately at 90 degrees, with respect to the longitudinal axis is spaced from the butt at a distance between 200 and 400 mm.

3. A golf club shaft according to claim 2, wherein said shaft includes, extending from said butt:

a first upper portion corresponding substantially to a part of said gripping zone;

a second flared portion connected to said first upper portion, said external radius of said second flared portion increasing locally toward said tip;

a third reversely flared portion connected to said second flared portion, said external radius of said third reversely flared portion decreasing continually in a direction toward said tip; and wherein said large diameter bending zone comprises at least portions of a lower part of said first upper portion, said second flared portion, and an upper part of said third reversely flared portion.

4. A golf club shaft according to claim 3, wherein:

said first upper portion is a flared portion in which said external radius decreases continually up to the connection of said first portion and said second portion.

5. A golf club shaft according to claim 2, wherein:

said fiber layer oriented at 90 degrees, or approximately at 90 degrees, has a length between 40 and 500 mm.

6. A golf club shaft according to claim 1, wherein said abrupt increase of said radius/thickness ratio is an increase of at least 30% from a point of minimum radius/thickness ratio.

7. A golf club shaft according to claim 1, wherein:

said layer of fibers oriented at 90 degrees, or approximately at 90 degrees, is a cloth comprising also fibers oriented at 0 degrees, or approximately at 0 degrees, with respect to the longitudinal axis.

8. A golf club shaft according to claim 1, wherein:

the structure includes at least two layers of oppositely oriented fibers whose value is substantially equal to ±45 degrees with respect to the longitudinal axis, said layers extending over the entire length of said golf club shaft.

9. A golf club shaft according to claim 1, wherein:

the structure includes at least one layer of fibers oriented substantially in the same direction as the longitudinal axis of said golf club shaft.

10. A golf club shaft according to claim 1, wherein:

said layers constituting the structure of said shaft are composed of unidirectional layers of carbon and/or glass fibers.

11. A golf club shaft according to claim 1, wherein:

said golf club shaft has a total mass of less than 85 grams, said layer of fibers being oriented at 90 degrees, or approximately at 90 degrees, with respect to the longitudinal axis having a mass less than or equal to 15 grams.

12. A golf club shaft according to claim 1, wherein:

said golf club shaft has a total mass of less than 75 grams, said layer of fibers being oriented at 90 degrees, or approximately at 90 degrees, with respect to the longitudinal axis having a mass less than or equal to 15 grams.

13. A golf club shaft comprising:

a tubular structure extending along a longitudinal axis and having, along a length, a varying section defined by an external radius and a thickness of said structure;

said shaft including an enlarged butt and an opposite tip with a smaller external radius;

said shaft comprising a bending zone located approximately along the second upper quarter of the shaft length that includes an area of abrupt variation of a radius/thickness ratio;

said structure including a plurality of layers of reinforcing fibers having different orientations with respect to said longitudinal axis; and said structure comprising at least one layer of unidirectional fibers oriented at 90 degrees, or approximately at 90 degrees, with respect to the longitudinal axis that extends at least over said area of abrupt variation of the radius/thickness ratio and that is spaced from the butt.

14. A golf club shaft according to claim 13, wherein:

said layer of fibers oriented at 90 degrees, or approximately at 90 degrees, is a cloth comprising also fibers oriented at 0 degrees, or approximately at 0 degrees, with respect to the longitudinal axis.

15. A golf club shaft according to claim 13, wherein:

said area of abrupt variation of the radius/thickness ratio comprises a local portion of increase of at least 30% of said ratio value from a minimum ratio value and in a direction toward said tip.

16. A golf club shaft according to claim 13, wherein:

said area of abrupt variation of said radius/thickness ratio corresponds to a local increase of at least 40% of the ratio value from a minimum ratio value and in a direction toward said tip.

17. A golf club shaft comprising:

a tubular structure extending along a longitudinal axis and having, along a length, a varying section defined by an external radius and a thickness of said structure;

said shaft including a butt having an external radius and an opposite tip with a smaller external radius than said external radius of said butt;

said shaft including a gripping zone in a vicinity of said butt and a large diameter bending zone of greater deformation during a swing motion located beneath said gripping zone;

said large diameter bending zone having at least a significant enlarged portion where a radius/thickness ratio is greater than or equal to 6;

said structure including a plurality of layers of reinforcing fibers having different orientations with respect to said longitudinal axis;

said structure including at least one layer of fibers oriented at 90 degrees, or approximately at 90 degrees, with respect to the longitudinal axis that is spaced from said butt and extends at least over said enlarged portion.

18. A golf club shaft according to claim 17, wherein:

said layer of fibers oriented at 90 degrees, or approximately at 90 degrees, comprises part of a cloth comprising additional fibers oriented at 0 degrees, or approximately 0 degrees, with respect to the longitudinal axis.

19. A golf club shaft according to claim 17, wherein:

said enlarged portion has a length of at least 50 mm and extends in a direction toward said tip until a distance from said butt of at least 350 mm.

20. A golf club shaft according to claim 17, wherein:

said enlarged portion has a length of at least 100 mm and extends in a direction toward said tip until a distance from said butt of at least 380 mm.

* * * * *